US011655124B2

(12) United States Patent
Kashiwakura

(10) Patent No.: US 11,655,124 B2
(45) Date of Patent: May 23, 2023

(54) SUPPORT JIG FOR ASSEMBLING ELEVATOR CAR

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 0 days.

(21) Appl. No.: 17/589,980

(22) Filed: Feb. 1, 2022

(65) Prior Publication Data

US 2022/0250875 A1 Aug. 11, 2022

(30) Foreign Application Priority Data

Feb. 5, 2021 (JP) ..... JP2021-017186

(51) Int. Cl.
*B66B 19/04* (2006.01)
*B66B 11/02* (2006.01)
*B66B 19/00* (2006.01)

(52) U.S. Cl.
CPC ..... *B66B 19/04* (2013.01); *B66B 11/0226* (2013.01); *B66B 19/002* (2013.01)

(58) Field of Classification Search
CPC ..... B66B 19/002; B66B 7/027
See application file for complete search history.

(56) References Cited

FOREIGN PATENT DOCUMENTS

| | | | | | |
|---|---|---|---|---|---|
| CN | 105668408 | A | * | 6/2016 | |
| JP | S5623913 | B2 | | 6/1981 | |
| JP | H9151053 | A | | 6/1997 | |
| JP | 200426372 | A | | 1/2004 | |
| JP | 2004149258 | A | * | 5/2004 | |
| JP | 2008308248 | A | | 12/2008 | |
| JP | 2012180178 | A | * | 9/2012 | |
| JP | 2012180198 | A | | 9/2012 | |
| JP | 2019202868 | A | | 11/2019 | |
| JP | 2020117394 | A | | 8/2020 | |
| WO | WO-2016038678 | A1 | * | 3/2016 | ..... B66B 11/02 |

* cited by examiner

*Primary Examiner* — Diem M Tran
(74) *Attorney, Agent, or Firm* — The Webb Law Firm

(57) ABSTRACT

The present invention provides a support jig for assembling an elevator car including; a first member including a first member body configured to be detachably fixed to a car rail having a front surface and a rear surface and vertically extending in a shaft to guide the ascending and descending of the elevator car on the front surface side, and a mount part on which a component of the elevator car is mountable; and a second member including a second-member fixing part configured to be detachably fixed to the car rail, and a support part extending from the second-member fixing part and configured to support the mount part of the first member from below.

6 Claims, 10 Drawing Sheets

SUPPORT JIG FOR ASSEMBLING ELEVATOR CAR

CROSS-REFERENCE TO RELATED APPLICATION

This application claims priority to Japanese Patent Application No. 2021-017186 filed Feb. 5, 2021, the disclosure of which is hereby incorporated by reference in its entirety.

BACKGROUND OF THE INVENTION

Field of the Invention

The present invention relates to a support jig for assembling an elevator car detachably fixed to a car rail for use when an elevator car is assembled in a shaft.

Description of Related Art

Conventionally, there is known a car frame support base (a support jig for assembling an elevator car) used by being fixed to a car rail when an elevator car is assembled in a shaft (see JP S56-23913 B). Specifically, as shown in FIG. 10, a car-frame support base 100 includes a mounting member 104 configured to be fixed to a car rail 103 by a plurality of clips 101 and a plurality of bolts 102, a car frame receiving seat 105 formed integrally with the mounting member 104, a member 107 detachably fixed to the mounting member 104 by bolts 106, and a car frame receiving seat 108 formed integrally with the member 107.

In the car-frame support base 100, the mounting member 104 is disposed on the rear surface of the car rail 103 (i.e., on the side opposite to the side along which the elevator car is guided), the clips 101 are disposed on the front surface of the car rail 103 so that the car rail 103 is held between the mounting member 104 and the clips 104, and the bolts 102 are temporarily fastened to fix the mounting member 104 to the car rail 103.

Subsequent to the fixing of the member 107 to the mounting member 104 by the bolts 106, the height position and the posture of the car-frame support base 100 with respect to the car rail 103 are adjusted in a state where the bolts 102 attached to the mounting member 104 are temporarily loosened, so that two mounting surfaces (upper surfaces) of the car-frame support tables 105, 108 are horizontally held at a certain height position. Thereafter, the bolts 102 are tightly fastened to thereby fix the car-frame support base 100 to the car rail 103.

When the car frame support bases 100 are respectively fixed to a pair of car rails 103, the car frame 109 is mounted on the car-frame support tables 105, 108 of the car frame support bases 100. Accordingly, the car is assembled in this state.

In the adjustment of the height position and the posture of the car-frame support base 100 with respect to the car rail 103 at the time of mounting the car-frame support base 100 to the car rail 103, it was necessary to move the entire car-frame support base 100, while the bolts 102 that respectively fix the clips 101 to the mounting member 104 are kept loosened, for the aforementioned adjustment of the height position and the posture.

In the car frame support bases 100, a weight of the elevator car applied to the car frame support bases 100 during the elevator car is assembled is supported by holding the car rail 103 between the mounting member 104 and the plurality of clips 101. Because of this, the mounting member 104 was demanded to have a sufficient size enabling the plurality of clips 101 (six clips in the example shown in FIG. 10) to be disposed thereon, which causes increase in their weights. Therefore, the mounting operation of the car frame support bases 100 to the car rail 103 in the limited work space in the shaft was difficult to perform.

SUMMARY OF THE INVENTION

It is therefore an object of the present invention to provide a support jig for assembling an elevator car that can be easily installed to the car rail.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The support jig for assembling an elevator car according to the present invention includes: a first member including a first member body configured to be detachably fixed to a car rail having a front surface and a rear surface and vertically extending in a shaft to guide an elevator car on the front surface side, and a mount part on which a component of the elevator car is mountable; and a second member including a second-member fixing part configured to be detachably fixed to the car rail, and a support part extending from the second-member fixing part and configured to support the mount part of the first member from below.

The aforementioned support jig can be configured such that the first member body includes: a first-member fixing part configured to contact the car rail from the rear surface side of the car rail; and a plurality of clamping assemblies configured to fix the first-member fixing part to the car rail by being fixed to the first-member fixing part with the car rail held between the first-member fixing part and the plurality of clamping assemblies; wherein a magnitude of a clamping force of each of the plurality of clamping assemblies to clamp the car rail when the plurality of clamping assemblies are fixed to the first-member fixing part is adjustable.

The aforementioned support jig can be configured such that the first-member fixing part has a plurality of long holes respectively disposed at positions corresponding to both ends in the width direction of the car rail when the first-member fixing part is held in contact with the car rail, the plurality of long holes being long in the width direction of the car rail, each of the plurality of clamping assemblies includes: a clip configured to hold the car rail between the first-member fixing part and the clip; a bolt configured to be inserted into the long hole while passing through the clip; and a nut configured to come into threaded engagement with the bolt.

The aforementioned support jig can be configured such that the first-member fixing part has a first edge that is located close to the second member when the first-member fixing part is fixed to the car rail while being in contact with the rear surface of the car rail, the first edge inclined with respect to the vertical direction; the second-member fixing part has a second edge that is located close to the first member when the second-member fixing part is fixed to the car rail while being in contact with the rear surface of the car rail, the second edge extending along a direction in which the first edge extends, and configured to contact the first edge.

The aforementioned support jig can be configured such that the first member body and the mount part of the first member are detachably connected to each other in the first member, the first member body includes a connecting part that connects the first-member fixing part with the mount part, the first-member fixing part of the first member body and the second-member fixing part of the second member have the same size and the same shape, and the connecting part of the first member body and the support part of the second member have the same size and the same shape.

The aforementioned support jig can be configured such that each of the first-member fixing part and the second-member fixing part has a plate shape extending along the rear surface while being in contact with the car rail from the rear surface side.

The aforementioned support jig can be configured such that the mount part has a mounting surface facing upward when the first member is fixed to the car rail, and the mounting surface has a mark for positional alignment at a certain position in the width direction on the mounting surface.

BRIEF DESCRIPTION OF DRAWINGS

The aforementioned features and the other features of the present invention will be clarified by the following description and figures illustrating the embodiments of the present invention.

DESCRIPTION OF THE INVENTION

Hereinafter, a description will be given on one embodiment of the present invention with reference to FIG. 1 to FIG. 9.

The support jig for assembling an elevator car of this embodiment (hereinafter, also simply referred to as "the support jig") is detachably fixed to a car rail that vertically extends in a shaft and guides the elevator car, and is used for assembling the elevator car in the shaft. Hereinafter, a description will be given on the car rail to which the support jig is detachably fixed, and then a description will be given on a specific configuration of the support jig. Also in the description herein, the directional terms such as top, bottom, right, left, etc. when referring to the support jig and the respective configurations are respectively used on the basis of the state in which the support jig is attached to the car rail (see FIG. 7 and FIG. 8).

Figure 7:
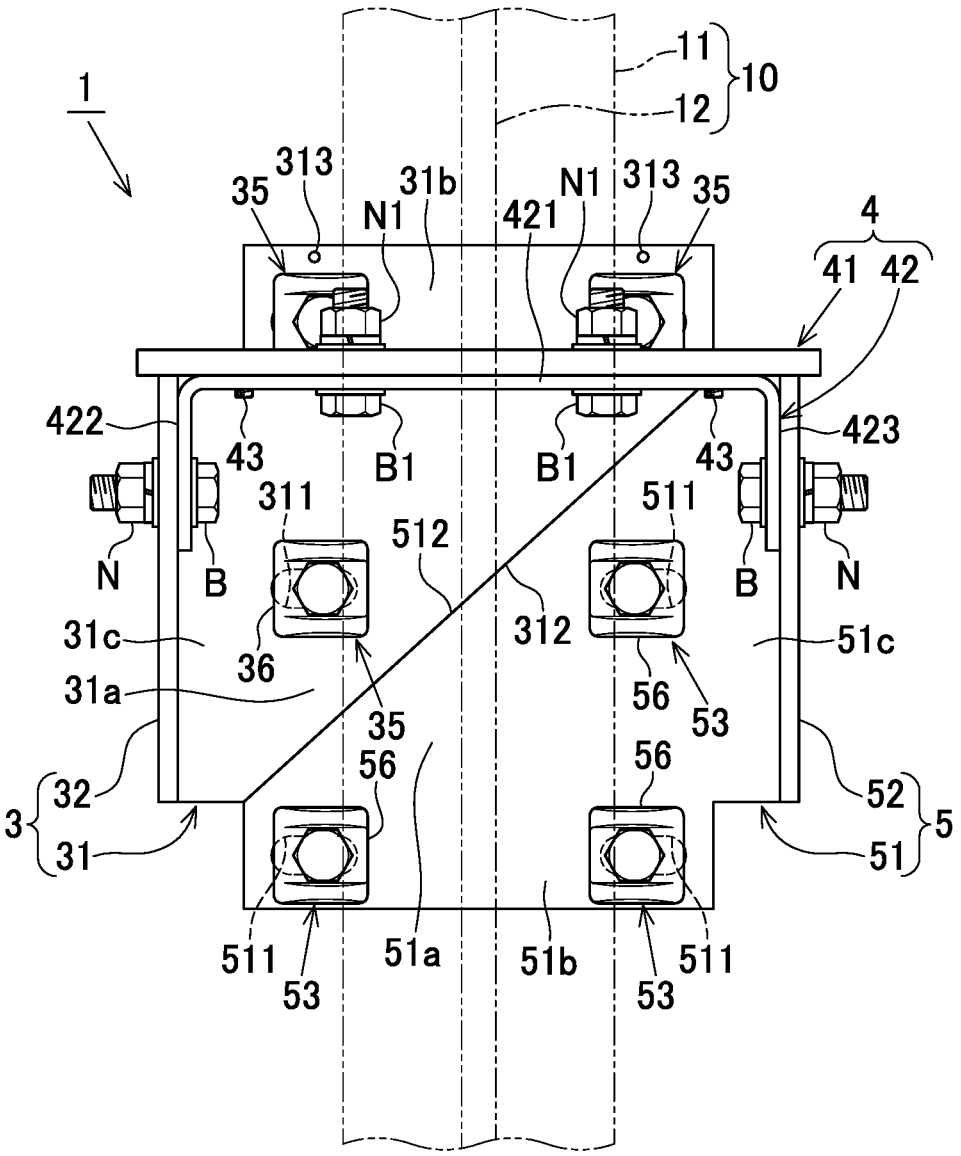
FIG. 7 is a front view of the support jig for assembling the elevator car.
Figure 8:
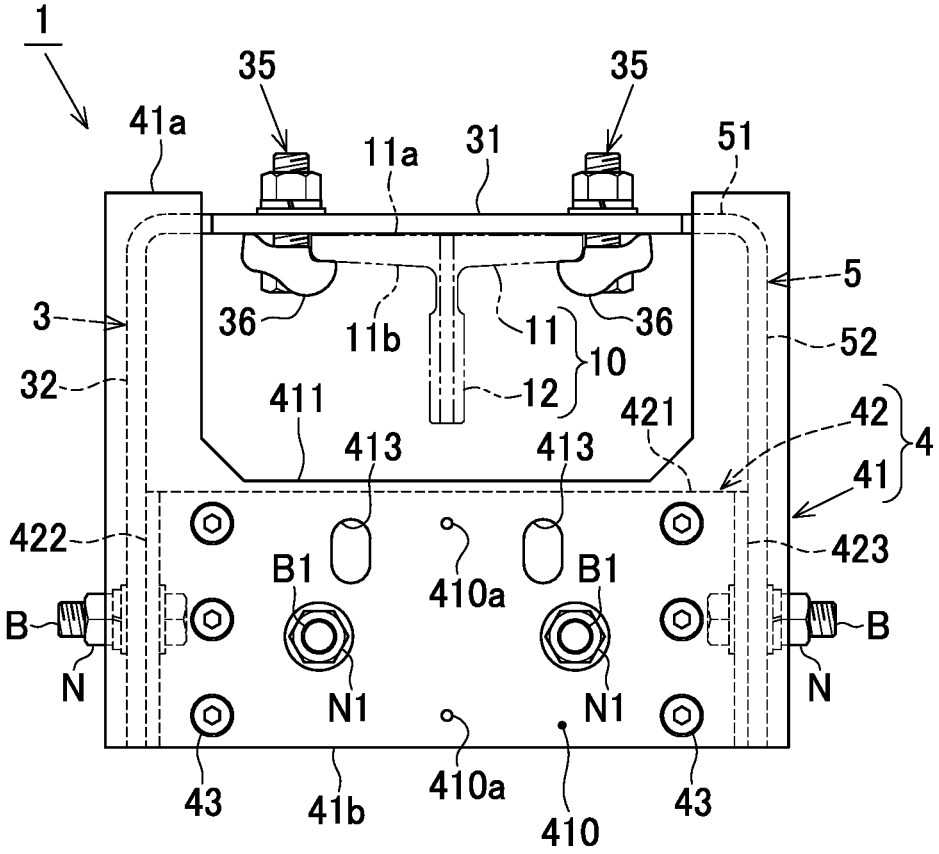
FIG. 8 is a plan view of the support jig for assembling the elevator car.
Figure 9:
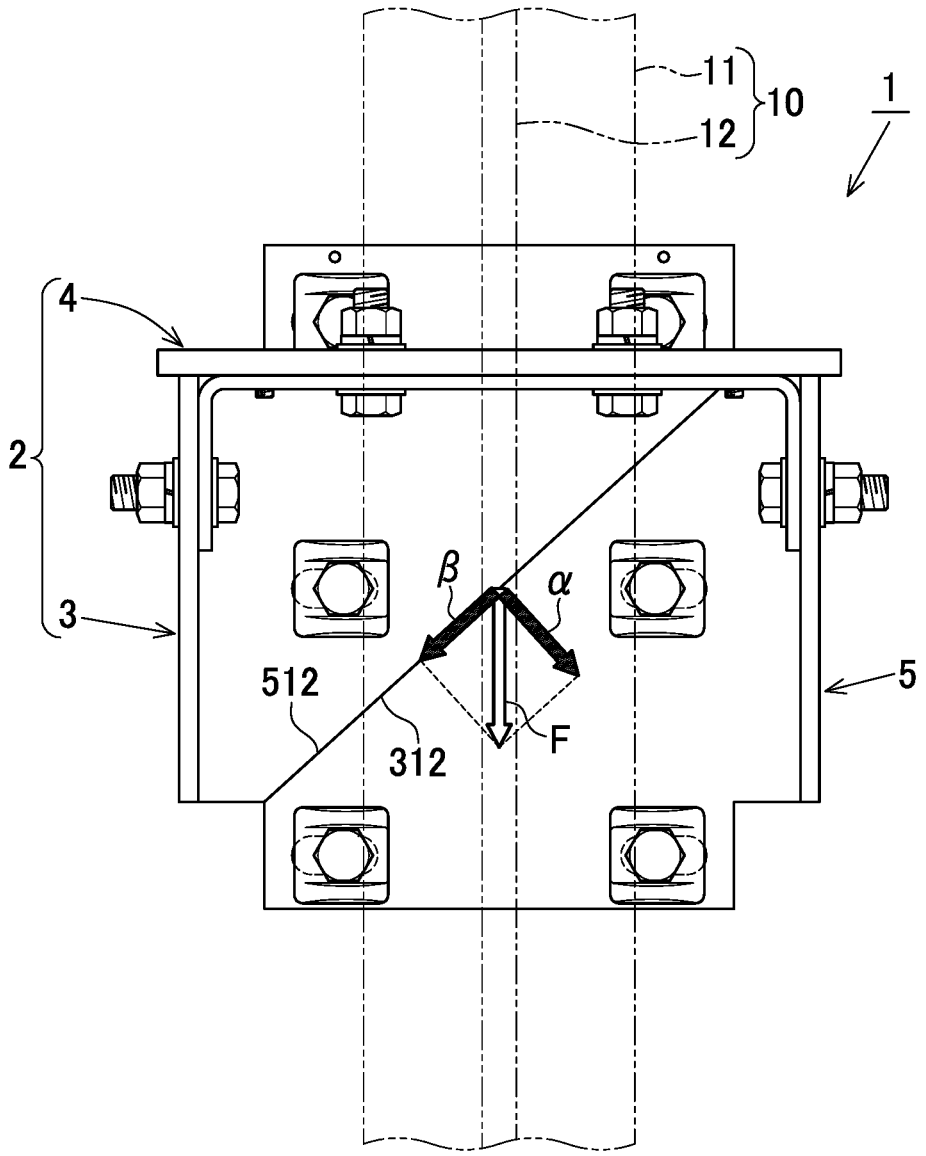
FIG. 9 is a schematic view for explanation of a state in which a downward force applied to a mount part is dispersed by the contact of a first edge of a first-member fixing part with a second edge of a second-member fixing part.
Figure 10:
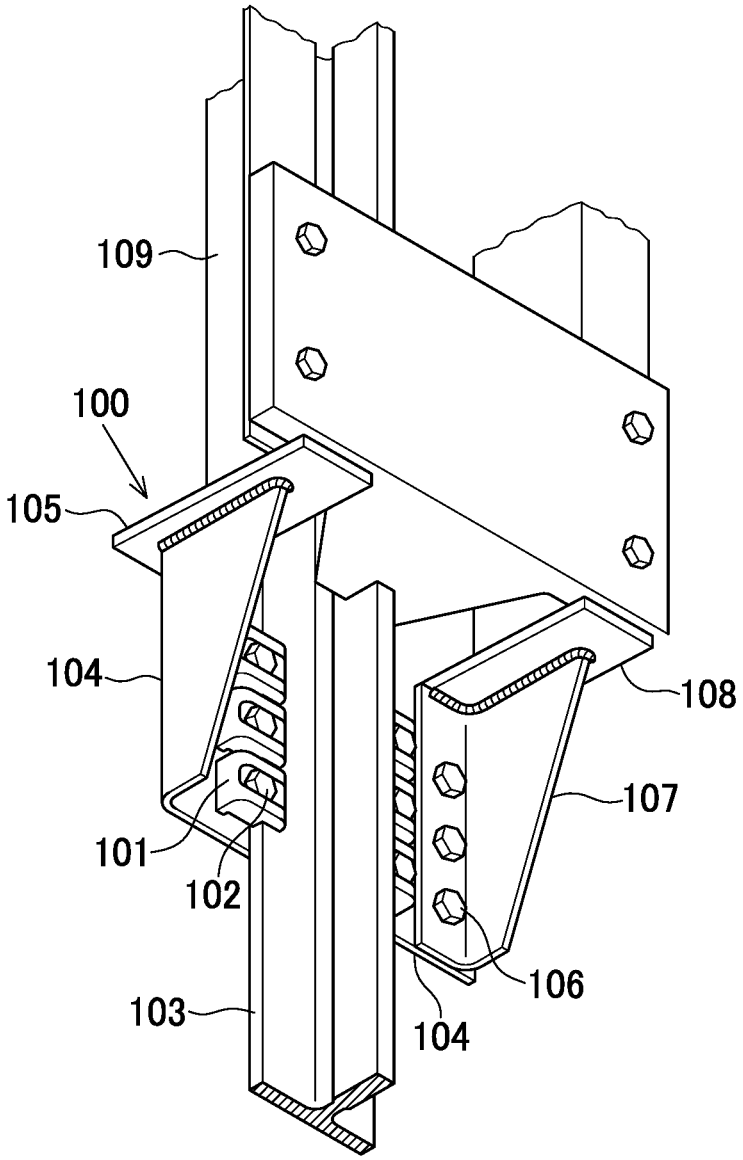
FIG. 10 is a perspective view of a conventional car frame support base.

A pair of car rails are provided for one car in an elevator shaft. The pair of car rails are disposed on both sides in a width direction of the car in the shaft (i.e., the direction orthogonal to an entrance direction) to guide the ascending and descending car. Specifically, as shown in FIG. 7 and FIG. 8, each of the pair of car rails 10 includes a rail base 11 having a vertically extending bar shape, and a rail web 12 vertically extending and protruding from the central part in the width direction of the rail base 11 toward the car side (that is, the direction orthogonal to each of the width direction and the vertical direction of the rail base 11). The rail base 11 is a portion fixed to, for example, a wall surface that defines the shaft, and the rail web 12 is a portion that is held in the thickness direction thereof between rollers of a roller guide provided in the car. In the description hereinafter, a rear surface 11*a* of the rail base 11 (i.e., the surface on the side opposite to a front surface 11*b* from which the rail web 12 protrudes) will be also referred to as the rear surface of the car rail 10, and the front surface of the car rail 10 (i.e., the surface from on which the rail web 12 protrudes) will be also referred to as the front surface of the car rail 10.

As shown in FIG. 1 to FIG. 8, the support jig 1 includes a first member 2 and a second member 5 that are respectively detachably attached to the car rail 10 and that are separable from each other. The support jig 1 further includes at least one coupling member that couples the first member 2 and the second member 5 to each other. In the support jig 1 of this embodiment, the at least one coupling member that couples the first member 2 and the second member 5 to each other is comprised of a bolt B and a nut N that is threadedly engaged with the bolt B.

The first member 2 includes a first member body 3 configured to be detachably fixed to the car rail 10, and a mount part 4 extending from the first member body 3 and configured to mount a component of the elevator car thereon. In the first member 2, the first member body 3 and the mount part 4 are separably connected to each other. The first member 2 further includes at least one coupling member that couples the first member body 3 and the mount part 4 to each other. In the first member 2 of this embodiment, the at least one coupling member has the same configuration as that of the coupling member that couples the first member 2 and the second member 5 to each other and is comprised of the bolt B and the nut N that is threadedly engaged with the bolt B.

The first member body 3 includes a first-member fixing part 31 configured to contact the car rail 10 from the rear surface 11*a* side of the car rail 10, a connecting part 32 for connecting the first-member fixing part 31 and the mount part 4 to each other, and a plurality of first clamping assembly (clamping assembly) 35 configured to detachably fix the first-member fixing part 31 to the car rail 10. In the first member body 3 of this embodiment, the first-member fixing part 31 and the connecting part 32 are integral with each other and formed by bending a plate-like member having a certain shape.

The first-member fixing part 31 extends from the connecting part 32 to the car rail 10, specifically, in the width direction of the rail base 11 (i.e., the left and right direction in FIG. 3: hereinafter, simply referred to as "the width direction"), and has a plurality of long holes 311 respectively disposed at both ends in the width direction of the rail base 11 when the first-member fixing part 31 is held in contact with the rear surface 11*a* of the car rail 10 (the rail base 11) while being long in the width direction. The first-member fixing part 31 of this embodiment is a plate-shaped portion extending along the rear surface 11*a* of the car rail 10 (in other words, a plate-shaped portion extending in the width direction and the vertical direction) and has three long holes 311 penetrating through the first-member fixing part 31 in a protruding direction of the rail web 12 (hereinafter, simply referred to as "the protruding direction"). The first-member fixing part 31 has two through holes (marks) 313 disposed with a distance from each other in the width direction.

In the first-member fixing part 31, a first edge 312 located close to the second member 5 viewed from the protruding direction inclined with respect to the vertical direction. Specifically, the first edge 312 is inclined inclines upward as it advances from one end on the connecting part 32 side in the width direction toward the other end on the opposite side. The first edge 312 of this embodiment extends in the direction at an angle of 45° with respect to the vertical direction.

Figure 1:
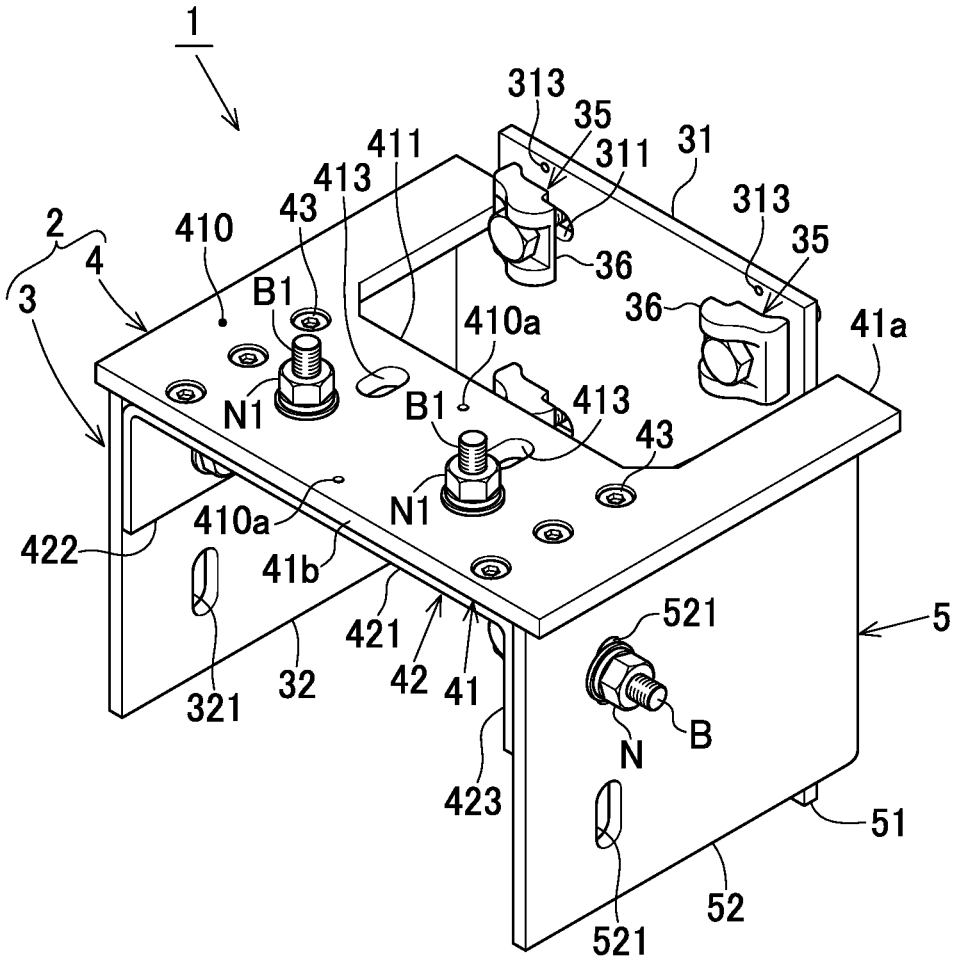
FIG. 1 is a perspective view of a support jig for assembling an elevator car according to an embodiment of the present invention.
Figure 2:
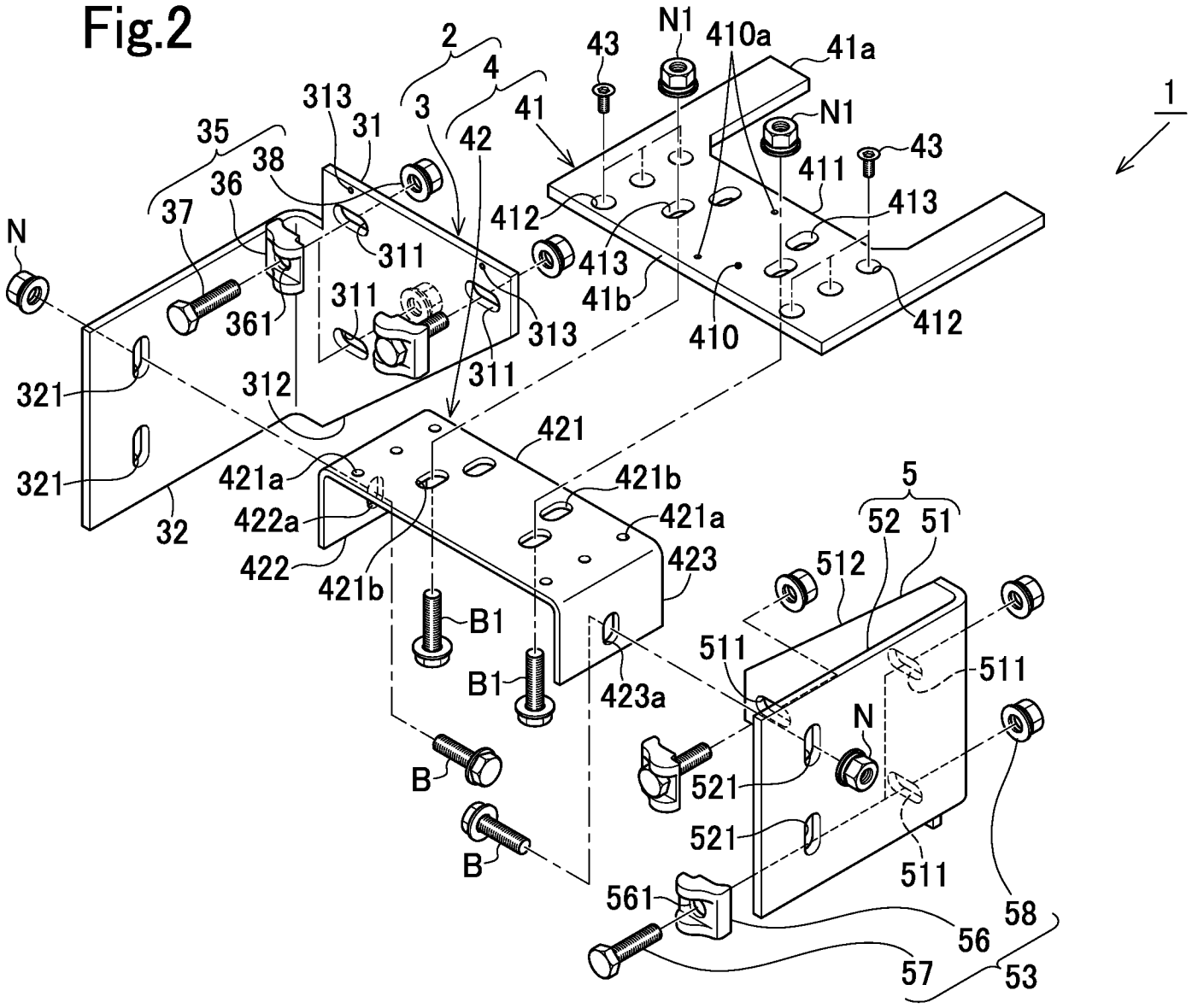
FIG. 2 is an exploded perspective view of the support jig for assembling the elevator car.
Figure 3:
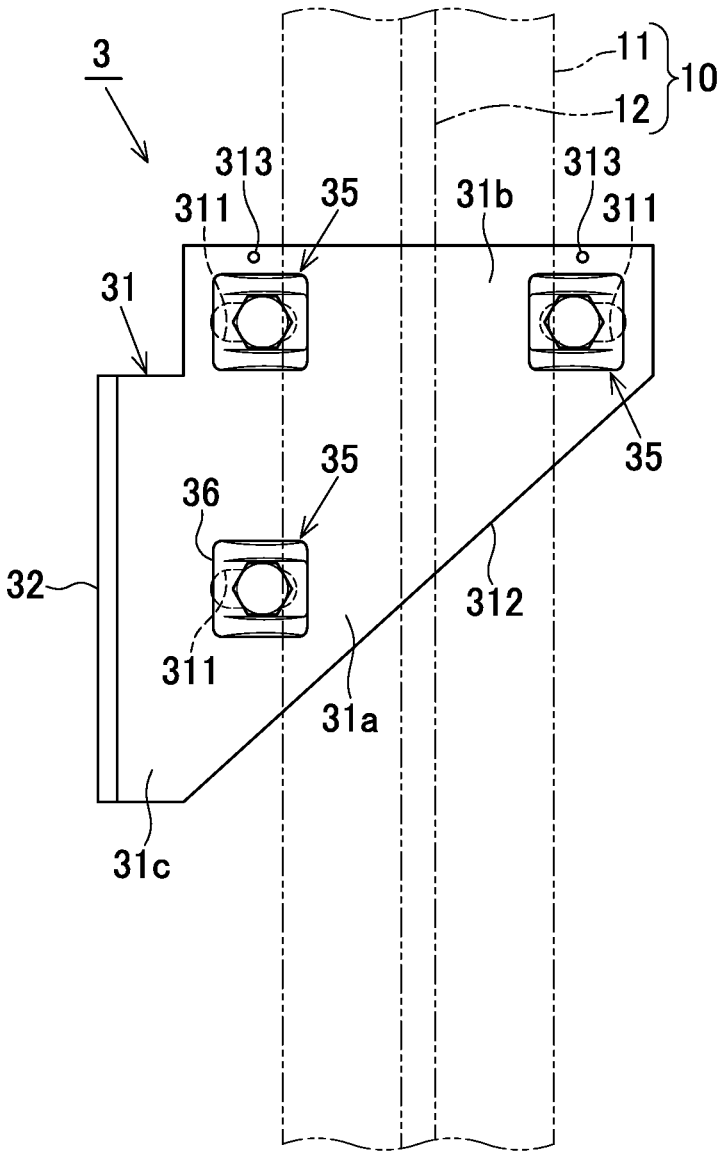
FIG. 3 is a front view of a first member body provided in the support jig for assembling the elevator car.

The first-member fixing part 31 of this embodiment has a triangular portion 31*a* including the first edge 312, a rectangular portion 31*b* extending upward from the triangular portion 31*a* and being elongated in the width direction, and a rectangular portion 31*c* extending from the triangular portion 31*a* and being elongated in the vertical direction (see FIG. 3).

The plurality of long holes 311 respectively penetrate through the plate-shaped first-member fixing part 31 in a thickness direction (i.e., the protruding direction) and extend in the width direction within an area including the edge in the width direction of the rail base 11. In the first-member fixing part 31 of this embodiment, two long holes 311 are disposed with a distance from each other in the vertical direction at positions corresponding to the edge on one side in the width direction of the rail base 1, and one long hole 311 is disposed at a position corresponding to the edge on the other side in the width direction of the rail base 11. The upper long hole 311 at the position corresponding to the edge on the one side of the rail base 11 is disposed at the same height as the long hole 311 at the position corresponding to the edge on the other side of the rail base 11. The two long holes 311 at the same height are disposed on the upper side of the connecting part 32. Specifically, the two long holes 311 are disposed in the rectangular portion (i.e., the upper end portion of the first-member fixing part 31) 31*b* extending upward from the triangular portion 31*a* in the first-member fixing part 31.

The two through holes 313 are disposed in the upper end portion of the first-member fixing part 31. Specifically, the two through holes 313 are disposed in the upper end portion (i.e., the rectangular portion) 31*b* of the first-member fixing part 31 respectively at the positions corresponding to the edge on the one side and the edge on the other side in the width direction of the rail base 11. The two through holes 313 are used as marks for positioning the first member body 3 relative to the rail base in the width direction when the first member body 3 is attached to the rail base 11. The two through holes 313 of this embodiment are disposed on the upper side of the two long holes 311 in the rectangular portion 31*b*. Note that the through holes 313 can have another form (for example, a recess or a projection) as long as they can be used as marks for positioning.

The connecting part 32 has at least one long hole 321 extending from the first-member fixing part 31 in the protruding direction and penetrating through the connecting part 32 in the width direction. Specifically, the connecting part 32 extends from the rectangular portion 31*c* of the first-member fixing part 31. The connecting part 32 is a plate-shaped portion extending in the protruding direction and in the vertical direction. The connecting part 32 of this embodiment is a rectangular portion and has two long holes 321.

The two long holes 321 are disposed with a distance from each other in the vertical direction and extend in the vertical direction. In the connecting part 32 of this embodiment, the two long holes 321 are disposed on a distal end (i.e., an end on the opposite side to the first-member fixing part 31 side in the protruding direction).

The plurality of first clamping assemblies 35 are fixed to the first-member fixing part 31 with the car rail 10 (specifically, the rail base 11) held between the first-member fixing part 31 and the first clamping assemblies 35 to thereby fix the first-member fixing part 31 to the car rail 10. The magnitude of the clamping force of each of the first clamping assemblies 35 to clamp the car rail 10 when they are fixed to (disposed on) the first-member fixing part 31 is adjustable.

Specifically, the plurality of first clamping assemblies 35 each include a clip 36 that is configured to clamp the car rail 10 (specifically, the rail base 11) between the first-member fixing part 31 and the first clamping assembly 35, a bolt 37 that is inserted into the long hole 311 of the first-member fixing part 31 while passing through the clip 36, and a nut 38 that comes into threaded engagement with the bolt 37. The magnitude of the clamping force of each of the first clamping assemblies 35 to clamp the car rail 10 between the first-member fixing part 31 and the first clamping assemblies 35 is adjustable (regulated) by adjusting the tightening force of the bolt 37 applied to the nut 38 (or the tightening force of the nut 38 applied to the bolt 38).

The clip 36 is a so-called rigid clip and is a plate-shaped member having a through hole 361 through which the bolt 37 is inserted. The clip 36 of this embodiment has a rectangular shape when viewed from the passing direction (i.e., the protruding direction) of the through hole 361, and is configured to fix the first-member fixing part 31 (specifically, the first member body 3) to the car rail 10 by the friction force generated by clamping the end part in the width direction of the rail base 11 between the first-member fixing part 31 and the clip 36 (specifically, the friction force between the clip 36 and the rail base 11, and the friction force between the rail base 11 and the first-member fixing part 31).

The mount part 4 has a mounting surface 410 facing upward with the first member 2 fixed (attached) to the car rail 10. When a car is assembled, a component of the car (a component that forms the car) is mounted on the mounting surface 410 of the mount part 4. Specifically, the mount part 4 includes a mounting plate 41 having the mounting surface 410, and a connecting member 42 configured to connect the mounting plate 41 with the first member body 3 and the second member 5.

The mounting plate 41 is a plate-shaped member extending in the horizontal direction, and the upper surface (i.e., the surface facing upward) of the mounting plate 41 forms the mounting surface 410. The mounting plate 41 has a rectangular shape when viewed in the vertical direction, and has a recessed part 411 recessing in the protruding direction having an edge 41*a* on the car rail 10 side. The recessed part 411 is a portion provided in the mounting plate 41 in order to prevent the contact of the mounting plate 41 with the car rail 10. The recessed part 411 of this embodiment is recessed in a rectangular shape with a dimension in the width direction larger than that of the rail base 11 and a dimension in the protruding direction larger than that of the rail web 12.

The mounting surface 410 has at least one mark 410*a* at a certain position in the width direction for positional alignment. That is, the mounting plate 41 has at least one mark 410*a* at a certain position in the width direction on the mounting surface 410. The mark 410*a* of this embodiment is a hole or a recess, and two marks 410*a* are disposed on the mounting surface 410 (i.e., the mounting plate 41). Specifically, two marks 410*a* are disposed at a central area in the width direction of the mounting surface at a distance from each other in the protruding direction.

Further, the mounting plate 41 has a plurality of coupling holes 412 used for coupling the mounting plate 41 with the connecting member 42, and a plurality of fixing long holes 413 used for fixing a component that forms the elevator car to the mounting plate 41 (i.e., the support jig 1).

The plurality of coupling holes 412 are disposed on both ends in the width direction of the mounting plate 41 at a distance from each other in the protruding direction. The plurality of fixing long holes 413 extend in the protruding direction. Specifically, in the mounting plate 41, a plurality of pairs of fixing long holes 413 are disposed in the protruding direction, in which the fixing long holes 413 in each pair are disposed at a distance from each other in the width direction. The distances in the width direction between the fixing long holes 413 in the respective pairs are different from each other.

The connecting member 42 includes a connecting member body 421 extending in the width direction and a pair of downwardly extending parts 422, 423 extending downward from both ends of the connecting member body 421. The connecting member body 421 and the pair of downwardly extending parts 422, 423 of this embodiment are formed integrally with each other, and the connecting member 42 is formed by bending the opposite ends of a rectangular band plate-shaped member.

The connecting member body 421 is a rectangular plate-shaped portion extending in the horizontal direction, and has coupling holes 421*a* at positions corresponding to the coupling holes 412 of the mounting plate 41, and fixing long holes 421*b* at positions corresponding to the fixing long holes 413 of the mounting plate 41. That is, the connecting member body 421 has a plurality of coupling holes 421*a* and a plurality of fixing long holes 421*b*. The coupling holes 421*a* of the connecting member body 421 of this embodiment are screw holes and the fixing long holes 421*b* of the connecting member body 421 of this embodiment are long holes extending in the protruding direction.

The pair of downwardly extending parts 422, 423 are rectangular plate-shaped portions extending in the protruding direction and the vertical direction, and respectively have through holes 422*a*, 423*a* penetrating through the downwardly extending parts 422, 423 in the thickness direction (i.e., the width direction). The downwardly extending part 422 on the connecting part 32 side has the through hole 422*a* at a position corresponding to the through hole 321 of the connecting part 32 on the upper side among the two long holes 321. Further, the downwardly extending part 423 on the side to which the second member 5 is connected (i.e., the opposite side of the connecting part 32) has the through hole 423*a* at the same height as that of the through hole 422*a* of the downwardly extending part 422 on the opposite side, that is, at a position overlapping with the through hole 422*a* when viewed from the width direction. The two through holes 422*a*, 423*a* are long holes extending in the vertical direction.

The mounting plate 41 and the connecting member 42 configured as above are coupled with each other by a plurality of coupling members 43. That is, the mount part 4 includes the plurality of coupling members 43 that couple the mounting plate 41 with the connecting member 42. The plurality of coupling members 43 of this embodiment are screws and are screwed into the coupling holes 421*a* of the connecting member body 421 while being inserted into the coupling holes 412 of the mounting plate 41, to thereby couple the mounting plate 41 and the connecting member 42 together.

The second member 5 includes a second-member fixing part 51 configured to be detachably fixed to the car rail 10, a support part 52 extending from the second-member fixing part 51 and configured to support the mount part 4 of the first member 2 from below, and a plurality of second clamping assemblies 53 configured to detachably fix the second-member fixing part 51 to the car rail 10. In the second member 5 of this embodiment, the second-member fixing part 51 and the support part 52 are formed integrally with each other and formed by bending a plate-like member having a certain shape. The second member 5 of this embodiment has the same size and the same shape (configuration) as those of the first member body 3. That is, the second-member fixing part 51 of the second member 5 and the first-member fixing part 31 of the first member body 3 have the same size and the same shape. Also, the support part 52 of the second member 5 and the connecting part 32 of the first member body 3 have the same size and the same shape. A detailed description will be given below.

The second-member fixing part 51 is a portion configured to contact the car rail 10 from the rear surface 11*a* side of the car rail 10. The second-member fixing part 51 extends from the support part 52 in the width direction, and has a plurality of long holes 511 respectively formed at positions corresponding to both ends in the width direction of the rail base 11 when the second-member fixing part 51 is held in contact with the rear surface 11*a* of the car rail 10, in which these long holes are long in the width direction. The second-member fixing part 51 of this embodiment is a plate-shaped portion extending along the rear surface 11*a* of the car rail 10 (in other words, a plate-shaped portion extending in the width direction and in the vertical direction) and has three long holes 511 penetrating through the second-member fixing part 51 in the protruding direction.

In the second-member fixing part 51, a second edge 512 located close to the first member 2 (specifically, the first member body 3) when viewed from the protruding direction extends in a direction in which the first edge 312 of the first-member fixing part 31 extends, while being in contact with the first edge 312. That is, the second edge 512 is inclined with respect to the vertical direction. Specifically, the second edge 512 is inclined to extend downward in the width direction of the car rail 10 as it advances from one end on the support part 52 side toward an other end on the opposite side. The second edge 512 of this embodiment extends at an angle of 45° with respect to the vertical direction while being in contact with the entire region or substantially the entire region of the first edge 312 in a direction in which the second edge 512 extends.

There is no need for the second edge 512 of the second-member fixing part 51 to be in contact with the entire region of the first edge 312 of the first-member fixing part 31 in the direction in which the second edge 512 extends, and only a partial region of the second edge 512 in the direction in which the second edge 512 extends can be in contact with of the first edge 312 due to, for example, manufacturing errors or mounting conditions to the car rail 10. Further, a gap can be generated throughout the entire region in the direction in which the second edge 512 extends, between the second edge 512 of the second-member fixing part 51 and the first edge 312 of the first-member fixing part 31 in the entire region in the direction in which the second edge 512 extends.

The second-member fixing part 51 of this embodiment has a triangular portion 51*a* including the second edge 512, a rectangular portion 51*b* extending downward from the triangular portion 51*a* and being elongated in the width direction, and a rectangular portion 51*c* extending from the triangular portion 51*a* and being elongated in the vertical direction (see FIG. 7).

The plurality of long holes 511 respectively penetrate through the plate-shaped second-member fixing part 51 in a thickness direction (i.e., the protruding direction) and extend in the width direction within an area including the edge in the width direction of the rail base 11. In the second-member fixing part 51 of this embodiment, two long holes 511 are disposed with a distance from each other in the vertical direction at positions corresponding to the edge on the other side in the width direction of the rail base 11, and one long hole 511 is disposed at a position corresponding to the edge on the one side in the width direction of the rail base 11. The lower long hole 511 at the position corresponding to the edge on the other side of the rail base 11 is disposed at the same height as the long hole 511 at the position corresponding to the edge on the one side of the rail base 11. The two long holes 511 at the same height are disposed on the lower side of the support part 52. Specifically, the two long holes 511 are disposed in the rectangular portion (i.e., the lower end portion of the second-member fixing part 51) 51*b* extending downward from the triangular portion 51*a* in the second-member fixing part 51.

The support part 52 extends from the second-member fixing part 51 in the protruding direction of the rail web 12 and has at least one long hole 521 penetrating through the support part 52 in the width direction. Specifically, the support part 52 extends from the rectangular portion 51*c* of the second-member fixing part 51 in the protruding direction. The support part 52 is a plate-shaped portion extending in the protruding direction and in the vertical direction. The support part 52 of this embodiment is a rectangular portion and has two long holes 521.

The two long holes 521 are disposed at a distance from each other in the vertical direction and extend in the vertical direction. In the support part 52 of this embodiment, the two long holes 521 are disposed on a distal end (i.e., an end on the side opposite to the second-member fixing part 51 side in the protruding direction).

The plurality of second clamping assemblies 53 are fixed to the second-member fixing part 51 with the car rail 10 (specifically, the rail base 11) held between the second-member fixing part 51 and the second clamping assemblies 53 to thereby fix the second-member fixing part 51 to the car rail 10. The magnitude of the clamping force of each of the second clamping assemblies 53 to clamp the car rail 10 when they are fixed to (disposed on) the second-member fixing part 51 is adjustable. Each of the plurality of second clamping assemblies 53 of this embodiment has the same configuration as that of each of the first clamping assemblies 35.

Specifically, the plurality of second clamping assemblies 53 each include a clip 56 that is configured to clamp the car rail 10 (specifically, the rail base 11) between the second-member fixing part 51 and the second clamping assembly 53, a bolt 57 that is inserted into the long hole 511 of the second-member fixing part 51 while passing through the clip 56, and a nut 58 that comes into threaded engagement with the bolt 57. The magnitude of the clamping force of each of the second clamping assemblies 53 to clamp the car rail 10 between the second-member fixing part 51 and the second clamping assemblies 53 is adjusted (regulated) by adjusting the tightening force of the bolt 57 applied to the nut 58 (or the tightening force of the nut 58 applied to the bolt 58).

The clip 56 is a so-called rigid clip and is a plate-shaped member having a through hole 561 through which the bolt 57 is inserted. The clip 56 of this embodiment has a rectangular shape when viewed from the passing direction (i.e., the protruding direction) of the through hole 561, and is configured to fix the second-member fixing part 51 (specifically, the second member 5) to the car rail 10 by the friction force generated by clamping the end part in the width direction of the rail base 11 between the second-member fixing part 51 and the clip 56 (specifically, the friction force between the clip 56 and the rail base 11, and the friction force between the rail base 11 and the second-member fixing part 51).

The support jig 1 configured as aforementioned is attached to the car rail 10 in the following manner.

Figure 4:
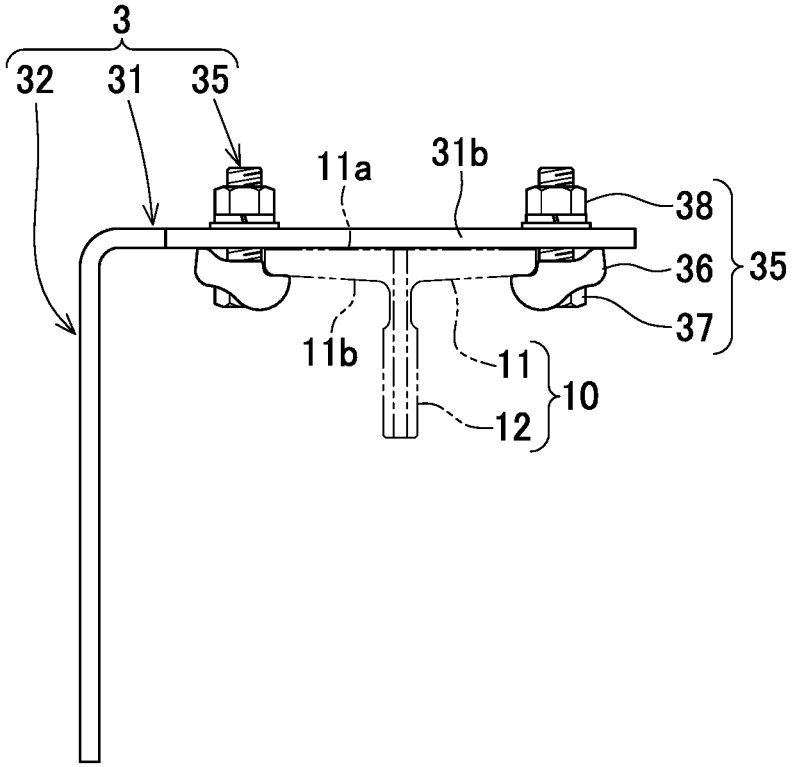
FIG. 4 is a plan view of the first member body.

First, as shown in FIG. 3 and FIG. 4, the first-member fixing part 31 of the first member body 3 is inserted into the gap between the rail base 11 of the car rail 10 and a wall (i.e., a wall surface that defines the shaft) from one side in the width direction. At this time, the position of the first-member fixing part 31 (i.e., the first member body 3) with respect to the car rail 10 is adjusted to allow the two long holes 311 on the upper end portion (i.e., the rectangular portion) 31*b* of the first-member fixing part 31 to be respectively disposed at the positions corresponding to the ends in the width direction of the rail base 11. In this position adjustment, the position of the first member body 3 in the width direction with respect to the rail base 11 is adjusted with the two through holes 313 provided in the upper end portion (i.e., the rectangular portion) 31*b* of the first-member fixing part 31 serving as marks for the positional alignment.

After the position adjustment, the first clamping assemblies 35 are respectively attached to the two long holes 311 on the upper end portion (i.e., the rectangular portion) 31*b* of the first-member fixing part 31. Specifically, each end in the width direction of the rail base 11 is held between the first-member fixing part 31 and the first clamping assembly 35, and the clip 36 is disposed at a position at which the through hole 361 overlaps with the long hole 311 of the first-member fixing part 31. In this state, the bolt 37 is inserted into the through hole 361 of the clip 36 and the long hole 311, and then the nut 38 is attached to the bolt 37 which has been inserted into the through hole 361 and the long hole 311. At this time, the bolt 37 or the nut 38 is tightened up to prevent the first member body 3 from dropping off from the rail base 11 in each of the first clamping assemblies 35 attached to the first-member fixing part 31. Thereby, the first member body 3 is temporarily fixed to the car rail 10.

Figure 5:
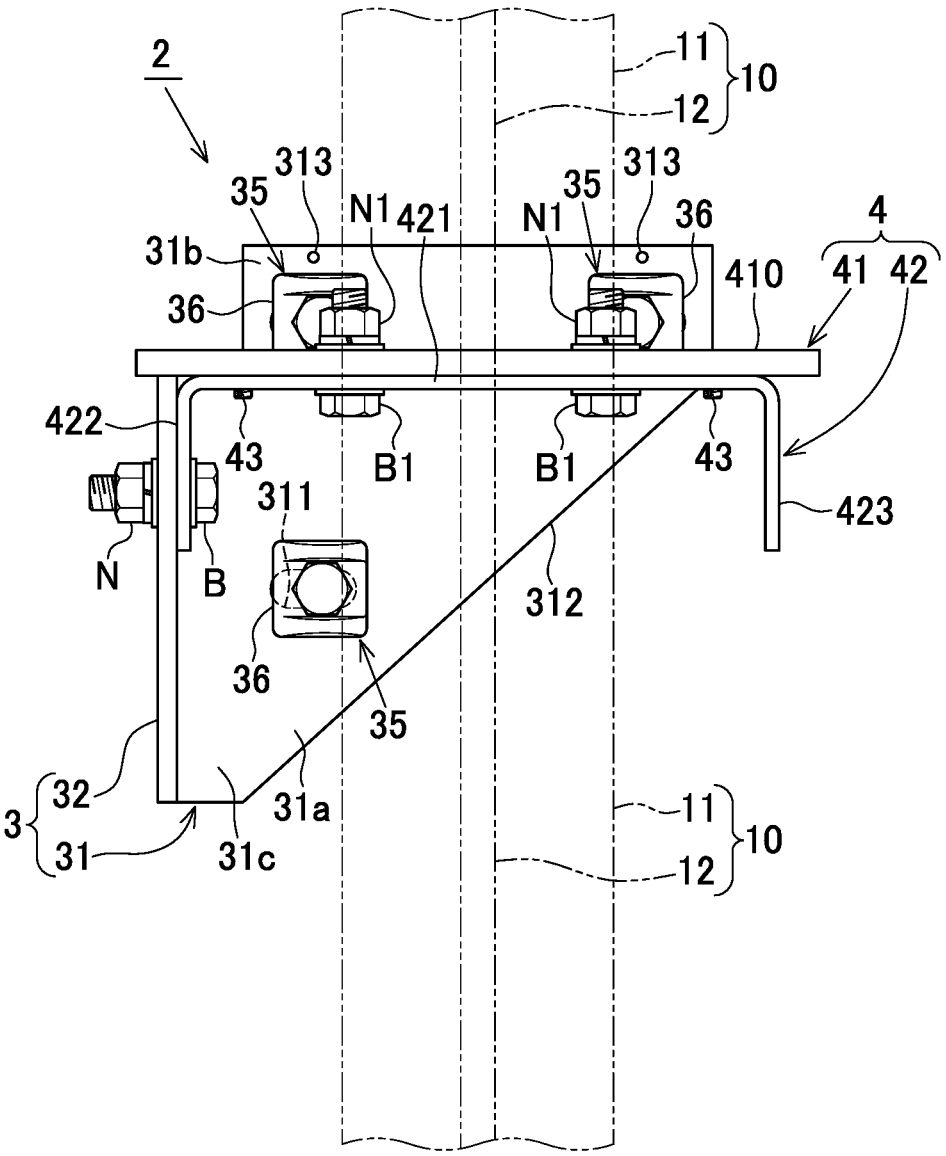
FIG. 5 is a front view of a first member provided in the support jig for assembling the elevator car.
Figure 6:
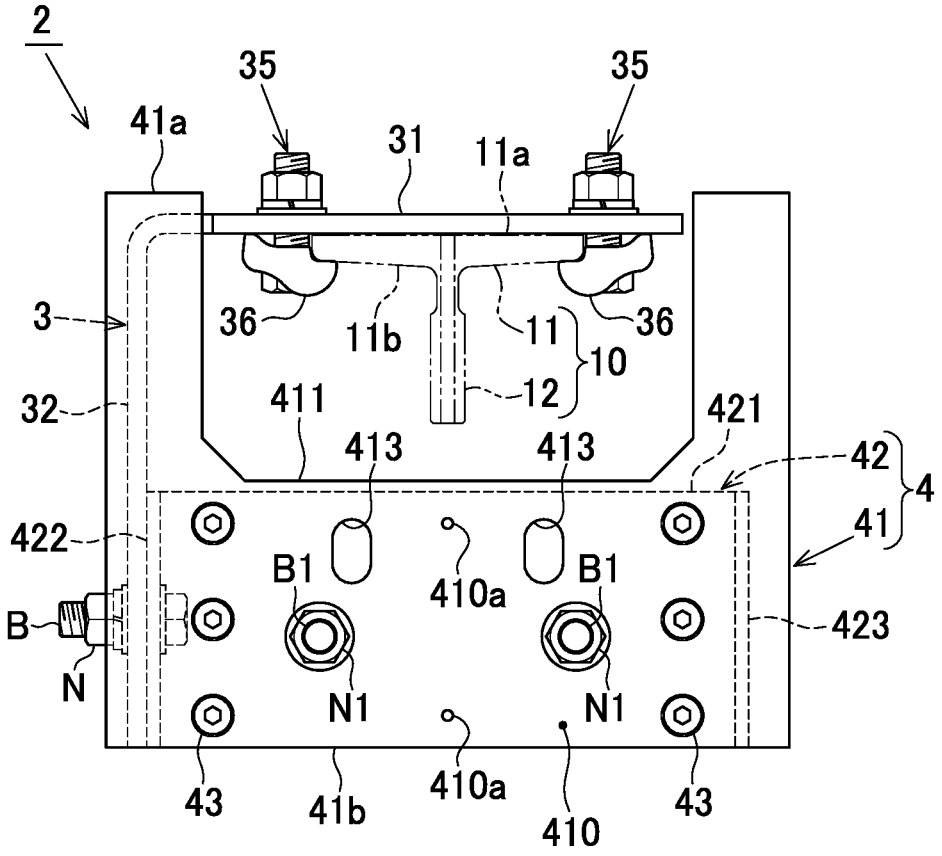
FIG. 6 is a plan view of the first member.

Next, as shown in FIG. 5 and FIG. 6, the mount part 4 (that is, the mounting plate 41 and the connecting member 42 in a coupled state) is attached to the first member body 3. Specifically, the mounting surface 410 is disposed to face upward, and the downwardly extending part 422 is held in contact with the connecting part 32 from the inside (i.e., the rail web 12 side of the car rail 10) to thereby allow the upper long hole 321 of the connecting part 32 in the first member body 3 to overlap with the through hole 422*a* of the downwardly extending part 422 in the mount part 4. In this state, the bolt B is inserted into the long hole 321 and the through hole 422*a*. Then, the nut N is attached to the bolt B that has been inserted into the long hole 321 and the through hole 422*a*. Thereby, the mount part 4 is connected to the connecting part 32 of the first member body 3.

At this time, the mount part 4 is connected to the first member body 3 to have the edge 41*b* in the protruding direction of the mounting plate 41 (i.e., the edge opposite to the edge 41*a* defining the recessed part 411) coinciding with the distal end in the protruding direction of the connecting part 32.

Next, in a state where the bolts 37 of the first clamping assemblies 35 are loosened, the position and the posture of the first member 2 with respect to the car rail 10 are adjusted to allow the mounting surface 410 in a horizontal state to be disposed at a desired height with respect to the car rail 10 (for example, at a position at which the upper end of a sill of the elevator car to be assembled (i.e., the upper end of a component that defines the lower end of the car entrance) to coincide with the floor level of the bottom floor), and to allow the rail web 12 of the car rail 10 to be located on a virtual line connecting the two marks 410*a* of the mounting surface 410. After the adjustment, the bolts 37 of the first clamping assemblies 35 are respectively tightened.

Subsequently, the first clamping assemblies 35 are attached to the remaining ones of the long holes (i.e., the long holes of the triangular portion 31*a*) 311 of the first-member fixing part 31 to thereby fix the first member 2 to the car rail 10. Note that the first clamping assemblies 35 may not need to be attached to the long holes 311 of the triangular portion 31*a* of the first-member fixing part 31 in the case where the weight of the elevator car to be assembled on the mount part 4 of the support jig 1 is small.

Next, as shown in FIG. 7 and FIG. 8, the second-member fixing part 51 of the second member 5 is inserted into the gap between the rail base 11 of the car rail 10 and the wall (i.e., the wall surface that defines the shaft) from the other side in the width direction. At this time, the second-member fixing part 51 is inserted into the gap so that the second edge 512 of the second-member fixing part 51 comes in contact with the first edge 312 of the first-member fixing part 31, while the downwardly extending part 423 comes into contact with the support part 52 from the inside (i.e., the rail web 12 side of the car rail 10) with the upper long hole 521 of the support part 52 in the second member 5 overlapping with the through hole 423*a* of the downwardly extending part 423 in the mount part 4. In this state, the bolt B is inserted into the long hole 521 and the through hole 423*a* to allow the nut N to be attached to the bolt B that has been inserted into these holes and allow the second clamping assemblies 53 to be respectively attached to the long holes 511 on the lower end portion (i.e., the rectangular portion) 51*b* of the second-member fixing part 51.

Subsequently, the second clamping assemblies 53 are attached to the remaining ones of the long holes (i.e., the long holes of the triangular portion 51*a*) 511 of the second-member fixing part 51 to thereby fix the second member 5 to the car rail 10. Note that the first clamping assemblies 53 may not need to be attached to the long holes 511 of the triangular portion 51*a* of the second-member fixing part 51 in the case where the weight of the elevator car to be assembled on the mount part 4 of the support jig 1 is small.

When the support jig 1 is attached (fixed) to each of the pair of car rails 10, the assembling of the elevator car is performed on the mount parts 4 of these two support jigs 1. At this time, the fixing long holes 413 of each of the mounting plate 41 of the support jigs 1 are used. Specifically, the assembling of the elevator car is performed while a component of the elevator car is fixed to the mounting plate 41 (the mount part 4) by, for example, the bolt B1 and the nut N1.

When the assembling of the elevator car is completed, roping is performed and thereafter the support jig 1 is removed from each of the car rails 10. Subsequently, guide rollers are attached to the portions of the elevator car to which the mounting plates 41 of the support jigs 1 were fixed. Finally, the assembling and installing the elevator car are completed.

As in the support jig 1 as aforementioned, when the weight of the elevator car is supported by the two separate members (that is, by the components to be fixed to the car rail 10 while being subjected to a downward force applied to the mount part 4), it is possible to achieve downsizing and weight saving of the components (i.e., the first member 2, the second member 5) as compared with the configuration in which the weight of the elevator car is supported by a single member. Moreover, when the configuration is such that the posture and the position in the vertical direction of the mount part 4 can be adjusted by only the one of the two members (i.e., the first member 2 in the example of this embodiment) at the time of fixing this member (i.e., the first member 2), it is possible to easily install the support jig 1 to the car rail 10.

Also in the support jig 1 of this embodiment, the first member body 3 includes the first-member fixing part 31 configured to contact the car rail 10 from the rear surface 11*a* side of the car rail 10, and the plurality of first clamping assemblies 35 configured to fix the first-member fixing part 31 to the car rail 10 by being fixed to the first-member fixing part 31 with the car rail 10 held between the first-member fixing part 31 and the plurality of clamping assemblies 35. The magnitude of the clamping force of each of the first clamping assemblies 35 to clamp the car rail 10 is adjustable when they are fixed to (disposed on) the first-member fixing part 31. When the configuration is such that the magnitude of the clamping force of each of the first clamping assemblies 35 to clamp the car rail 10 is adjustable as described above, it is possible to achieve fine adjustment of the posture and the position in the vertical direction of the first member 2 with respect to the car rail 10, that is, fine adjustment of the posture and the position in the vertical direction of the mount part 4 extending from the first member body 3 in the state where the first member 2 is temporarily fixed to the car rail 10 (i.e., in the state where the first member 2 is prevented from dropping off from the car rail 10).

Also in the support jig 1 of this embodiment, the first-member fixing part 31 has the plurality of long holes 311 respectively disposed at the positions corresponding to both ends in the width direction of the car rail 10 when the first-member fixing part 31 is held in contact with the car rail 10, the plurality of long holes 311 being long in the width direction of the car rail 10. Each of the plurality of first clamping assemblies 35 includes a clip 36 configured to enable the car rail 10 to be held between the first-member fixing part 31 and the clip 36, a bolt 37 configured to be inserted into the long hole 311 while passing through the clip 36, and a nut 38 configured to come into threaded engagement with the bolt 37. Such a simple configuration to allow the nut 38 to come into threaded engagement with the bolt 37 passing through the clip 36 while being inserted through the long hole 311 of the first-member fixing part 31 can make it easy to achieve fine adjustment of the posture and the position in the vertical direction of the first member body 3 with respect to the car rail 10, while the first member body 3 is temporarily fixed to the car rail 10.

Also in the support jig 1 of this embodiment, the first edge 312 of the first-member fixing part 31 is inclined with respect to the vertical direction, when the first-member fixing part 31 is fixed to the car rail 10 while being in contact with the rear surface 11*a* of the car rail 10. The second edge 512 of the second-member fixing part 51 extends along the direction in which the first edge 312 extends, and contacts the first edge 312, when the second-member fixing part 51 is fixed to the car rail 10 while being in contact with the rear surface 11*a* of the car rail 10 (see FIG. 7). Since the first edge 312 and the second edge 512 that are configured to be in contact with each other are inclined with respect to the vertical direction as described above, the downward force (i.e., the weight of the elevator car to be assembled) applied to the first-member fixing part 31 through the mount part 4 is dispersed in a direction in which the first edge 312 and the second edge 512 extend (i.e., the inclined direction) and in a direction orthogonal to the inclined direction (see FIG. 9, particularly, arrows F, α, β). Thereby, the first member 2 is less likely to slip down from the position at which the first member 2 is fixed to the car rail 10.

Also in the support jig 1 of this embodiment, the first member body 3 and the mount part 4 of the first member 2 are detachable from each other, and the first member body 3 includes a connecting part 32 configured to connect the first-member fixing part 31 and the mount part 4. The first member body 3 and the second member body 5 have the same size and the same shape. That is, the first-member fixing part 31 and the second-member fixing part 51 have the same size and the same shape. Further, the connecting part 32 and the support part 52 have the same size and the same shape. The types of the components of the support jig 1 can be thus minimized by configuring the first member body 3 and the second member 5 to have the same size and the same shape as described above.

Also in the support jig 1 of this embodiment, the first-member fixing part 31 and the second-member fixing part 51 each have a plate shape extending along the rear surface 11*a*, while being brought into contact with the car rail 10 from the rear surface 11*a* side. Therefore, the first-member fixing part 31 and the second-member fixing part 51 can be disposed to be able to be brought into contact with the car rail 10 from the rear surface 11*a* side even in the case where the gap between the car rail 10 and the wall on the rear surface 11*a* side of the car rail 10 (e.g., a wall that defines the shaft) or between the car rail 10 and the component.

Also in the support jig 1 of this embodiment, the mount part 4 has a mounting surface 410 facing upward and this mounting surface 410 has a mark 410*a* at a certain position in the width direction. With this configuration, the positional alignment (positioning) of the mount part 4 in the width direction can be made by aligning the mark 410*a* of the mounting surface 410 in the width direction with the position of the rail web 12 of the car rail 10 when viewed from the direction in which the car rail 10 extends. That is, this configuration facilitates the position adjustment of the mounting surface 410 with respect to the car rail 10 in the width direction.

The support jig for assembling an elevator car of the present invention is not limited to the aforementioned embodiment, and it is, of course, that various modifications can be made without departing from the gist of the present invention. For example, a configuration of an embodiment may be added to a configuration of another embodiment, and part of a configuration of an embodiment may be replaced by a configuration of another embodiment. Further, part of a configuration of an embodiment may be deleted.

In the support jig 1 of this embodiment, the first member body 3 and the second member 5 have the same size and the same shape, but the present invention is not limited to this configuration. The first member body 3 and the second member 5 can respectively have different sizes and different shapes. Also in the support jig 1 of this embodiment, the first-member fixing part 31 and the second-member fixing part 51 are in contact with each other, while the first member 2 and the second member 5 are fixed to the car rail 10 and the second member 5 supports the mount part 4 of the first member 2 from below, but the present invention is not limited to this configuration. It can be configured such that the first-member fixing part 31 and the second-member fixing part 51 are separated from each other, while the first member 2 and the second member 5 are fixed to the car rail 10 and the second member 5 supports the mount part 4 of the first member 2 from below. That is, the first member 2 and the second member 5 can have any configuration as long as the second member 5 supports the mount part 4 of the first member 2 from below, while the first member 2 and the second member 5 are respectively fixed to the car rail 10.

Also in the support jig 1 of this embodiment, the first edge 312 of the first-member fixing part 31 and the second edge 512 of the second-member fixing part 51 are inclined in the same direction with respect to the vertical direction and extend straight, but the present invention is not limited to this configuration. The first edge 312 and the second edge 512 do not need to extend in the same direction, or do not need to be inclined with respect to the vertical direction. Further, the first edge 312 and the second edge 512 do not need to extend straight. That is, the first edge 312 or second edge 512 can be entirely or partly curved.

Also in the support jig 1 of this embodiment, the first clamping assembly 35 and the second clamping assembly 53 have the same configuration, but the present invention is not limited to this configuration. The first clamping assembly 35 and the second clamping assembly 53 can have different configurations.

Also in the support jig 1 of this embodiment, the first clamping assembly 35 and the second clamping assembly 53 are respectively configured to clamp a part (an end) of the car rail 10 between the clips 36, 56 and the first clamping assembly 35 or the second clamping assembly 53, but the present invention is not limited to this configuration. The first clamping assembly 35 and the second clamping assembly 53 can be configured to, for example, allow the clips 36, 56 to clamp a part of the car rail 10 in such a manner as to be able to adjust the magnitude of the clamping force, and to allow the clips 36, 56 to be fixed to the first-member fixing part 31 or the second-member fixing part 51.

Also in the support jig 1 of this embodiment, the mounting surface 410 (i.e., the mounting plate 41) is formed into a rectangular shape having the recessed part 411, but the present invention is not limited to this configuration. The mounting surface 410 is not limited to a specific shape. The mounting surface 410 can have any shape as long as it can mount a component of the car thereon when the car is assembled.

Also in the support jig 1 of this embodiment, the first member body 3 and the mount part 4 are detachably connected to each other, but the present invention is not limited to this configuration. The first member body 3 and the mount part 4 can be integrally formed. In this case, the mounting surface 410 (i.e., the mounting plate 41) has such a shape as to prevent the first-member fixing part 31 from contacting the rail web 12 of the car rail 10 when the first-member fixing part 31 is inserted into the rear surface 11*a* side of the car rail 10.

Also in the support jig 1 of this embodiment, three components are provided to fix the first member body 3 to the car rail 10 (the first clamping assemblies 35 in the example of the aforementioned embodiment), but two components can be provided. Also, four or more components can be provided to fix the second member 5 to the car rail 10 (the second clamping assemblies 53 in the example of the aforementioned embodiment). Minimizing the number of the components to fix the first member 2 to the car rail 10 (the first clamping assemblies 35 in the example of the aforementioned embodiment) can facilitate the adjustment of the position and the posture of the mount part 4 with respect to the car rail 10.

The support jig for assembling the elevator car of the present invention is described above by way of the above embodiments, but is not limited to the aforementioned embodiments. Thus, the support jig for assembling the elevator car according to the present invention can be subjected to various modifications within the intended scope of the present invention. Further, the operation and effect of the present invention are not limited to the above embodiments. That is, the embodiments disclosed herein should be considered to be illustrative in all respects and not restrictive. The scope of the present invention is indicated by the appended claims, not by the above description. It is also contemplated that the scope of the present invention includes all modifications within the meaning and scope of equivalence to the claims

What is claimed is:

1. A support jig for assembling an elevator car comprising:

a first member comprising a first member body configured to be detachably fixed to a car rail having a front surface and a rear surface and vertically extending in a shaft to guide the elevator car on the front surface side, and a mount part on which a component of the elevator car is mountable; and a second member comprising a second-member fixing part configured to be detachably fixed to the car rail, and a support part extending from the second-member fixing part and configured to support the mount part of the first member from below, wherein the first member body comprises:

a first-member fixing part configured to contact the car rail from the rear surface side of the car rail; and a plurality of clamping assemblies configured to fix the first-member fixing part to the car rail by being fixed to the first-member fixing part with the car rail held between the first-member fixing part and the plurality of clamping assemblies;

wherein the first-member fixing part has a first edge that is located close to the second member when the first-member fixing part is fixed to the car rail while being in contact with the rear surface of the car rail, the first edge inclined with respect to the vertical direction so as to be directed in an upward direction as it advances from one end toward the opposite side; and the second-member fixing part has a second edge that is located close to the first member when the second-member fixing part is fixed to the car rail while being in contact with the rear surface of the car rail, the second edge extending along a direction in which the first edge extends, and configured to contact the first edge.

2. The support jig according to claim 1, wherein a magnitude of a clamping force of each of the plurality of clamping assemblies to clamp the car rail when the plurality of clamping assemblies are fixed to the first-member fixing part is adjustable.

3. The support jig according to claim 2, wherein the first-member fixing part has a plurality of long holes respectively disposed at positions corresponding to both ends in a width direction of the car rail when the first-member fixing part is held in contact with the car rail, the plurality of long holes being long in the width direction of the car rail, each of the plurality of clamping assemblies comprises:

a clip configured to hold the car rail between the first-member fixing part and the clip;

a bolt configured to be inserted into the long hole while passing through the clip; and a nut configured to come into threaded engagement with the bolt.

4. The support jig according to claim 1, wherein the first member body and the mount part of the first member are detachably connected to each other, the first member body comprises a connecting part that connects the first-member fixing part with the mount part, the first-member fixing part of the first member body and the second-member fixing part of the second member have the same size and the same shape, and the connecting part of the first member body and the support part of the second member have the same size and the same shape.

5. The support jig according to claim 1, wherein each of the first-member fixing part and the second-member fixing part has a plate shape extending along the rear surface while being in contact with the car rail from the rear surface side.

6. The support jig according to claim 1, wherein the mount part has a mounting surface facing upward when the first member is fixed to the car rail, and the mounting surface has a mark for positional alignment at a certain position in the width direction on the mounting surface.

* * * * *